United States Patent [19]

Franke

[11] 4,221,968

[45] Sep. 9, 1980

[54] X-RAY DIAGNOSTIC GENERATOR COMPRISING AN INVERTER SUPPLYING THE HIGH VOLTAGE TRANSFORMER

[75] Inventor: Kurt Franke, Erlangen, Fed. Rep. of Germany

[73] Assignee: Siemens Aktiengesellschaft, Berlin & Munich, Fed. Rep. of Germany

[21] Appl. No.: 969,191

[22] Filed: Dec. 13, 1978

[30] Foreign Application Priority Data

Jan. 20, 1978 [DE] Fed. Rep. of Germany ..... 2802424

[51] Int. Cl.[2] ..... H05G 1/30

[52] U.S. Cl. ..... 250/402; 250/409

[58] Field of Search ..... 250/408, 409, 421, 402

[56] References Cited

U.S. PATENT DOCUMENTS 3,828,194 8/1974 Grasser ..... 250/408

*Primary Examiner*—Craig E. Church

*Attorney, Agent, or Firm*—Hill, Van Santen, Steadman, Chiara & Simpson

[57] ABSTRACT

The inverter delivers a supply frequency for the high voltage transformer which lies in the kHz-range. There is connected to the input of the inverter a smoothing circuit which is fed by a mains rectifier. There is series connected to the smoothing circuit a phase gating control for controlling the duty cycle of the pulses supplied to the smoothing circuit and thus for controlling the x-ray tube voltage.

2 Claims, 2 Drawing Figures

X-RAY DIAGNOSTIC GENERATOR COMPRISING AN INVERTER SUPPLYING THE HIGH VOLTAGE TRANSFORMER

BACKGROUND OF THE INVENTION

The invention relates to an x-ray diagnostic generator comprising an x-ray tube, a high voltage transformer supplying the x-ray tube, an inverter connected to the input of the high voltage transformer, a mains rectifier feeding the inverter and an adjustment member for the x-ray tube voltage.

An x-ray diagnostic generator of this type is described in the German Offenlegungsschrift No. 2,128,248. In the case of an x-ray diagnostic generator of this type, it is possible to select the supply frequency of the transformer in the kHz-range; i.e., substantially higher than the mains frequency. On account of this high supply frequency, the high voltage transformer can be provided with a substantially smaller and more lightweight construction than in the case of an x-ray diagnostic generator which is operated with the mains frequency. In order to regulate the x-ray tube voltage, the inverter is utilized here as a control unit. The x-ray tube voltage is controlled by determining the pulse duty factor of the output voltage of the high voltage transformer, and hence also of the inverter, in dependence upon the difference between the actual and the desired value of the x-ray tube voltage. An inverter wherein this pulse duty factor is controllable by means of a voltage corresponding to this difference is, however, very complicated in its construction.

SUMMARY OF THE INVENTION

The object underlying the invention consists in simplifying an x-ray diagnostic generator of the type initially recited with regard to the construction of the control means for the x-ray tube voltage.

In accordance with the invention, this object is achieved by virtue of the fact that a smoothing circuit is connected to the input of the inverter, to which smoothing circuit there is series connected a phase gating control device for the voltage supplied to it, which forms the control for the x-ray tube voltage. In the inventive x-ray diagnostic generator, the output voltage of the smoothing (or filter) circuit, which is the input voltage of the inverter, is dependent upon the respectively through-connected phase angle (or angle of phase difference). Accordingly, by varying this phase angle, an influencing of the x-ray tube voltage is possible by simple means.

The invention shall be explained in greater detail in the following on the basis of a sample embodiment illustrated in the accompanying sheet of drawings; and other objects, features and advantages will be apparent from this detailed disclosure and from the appended claims.

DETAILED DESCRIPTION

Figure 1:
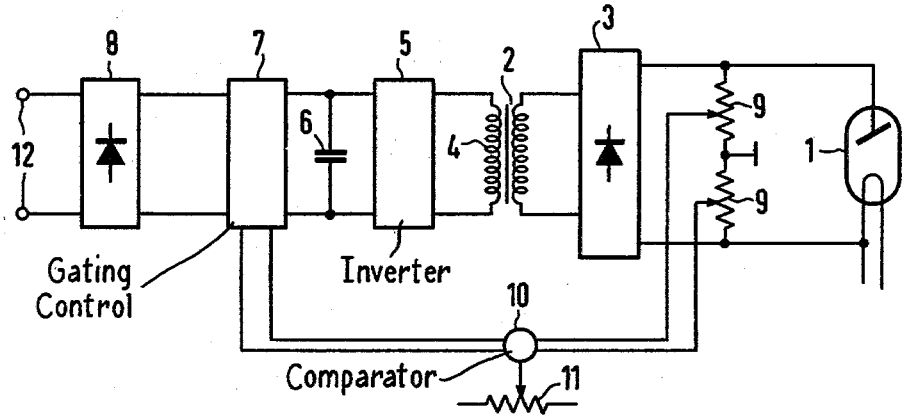
FIG. 1 illustrates an x-ray diagnostic generator in accordance with the invention.

In FIG. 1, an x-ray tube 1 is illustrated which is fed by a high voltage transformer 2 via a high voltage rectifier 3. There is connected to the primary winding 4 of the high voltage transformer 2 the output voltage of the inverter 5 whose input voltage is tapped at a smoothing (or filter) capacitor 6. The smoothing capacitor 6 receives the output voltage of a phase gating control device 7 for the output voltage of a mains rectifier 8. In order to control the x-ray tube voltage, an actual value generator 9 is provided at which a signal is tapped corresponding to the actual value of the x-ray tube voltage. This signal is compared in a comparator 10 with a setpoint value signal delivered by a setpoint value generator 11. The phase angle of the phase gating control device 7 is adjusted corresponding to the difference between the actual and the setpoint value of the x-ray tube voltage.

Figure 2:
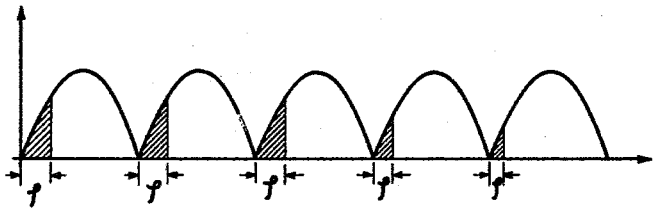
FIG. 2 illustrates a curve for explaining FIG. 1.

In FIG. 2, the output half-waves of the mains rectifier 8, constructed as a bridge rectifier, are illustrated. Those portions are hatched which are, for example, through-connected (or through-put) to the smoothing capacitor 6 by means of the phase gating control device 7. From FIG. 2, it is clearly apparent that, by varying the phase angle $\phi$, the charging voltage for the smoothing capacitor 6 and hence also the x-ray tube voltage can be controlled.

The phase gating control device can also be connected between the mains terminals 12 and the mains rectifier 8. In this instance, a phase gating ensues with respect to the a.c. voltage which is supplied to the mains rectifier 8.

It is well within the skill in the art to construct a thyristor circuit to implement component 7 between rectifier 8 (with a full wave rectified output) and smoothing capacitor 6, which thyristor circuit is rendered conductive for time intervals ($\phi$, FIG. 2) in each half cycle of the mains supply 12 according to the magnitude of the error voltage from comparator 10.

An inverter circuit operating with unidirectional input (such as provided by such a thyristor circuit at 7 and capacitor 6, FIG. 1), is shown in U.S. Ser. No. 943,067 filed Sept. 18, 1978 (assignee Case VPA 77 P 5106 USA).

It will be apparent that many modifications and variations may be effected without departing from the scope of the novel concepts and teachings of the present invention.

I claim as my invention:

1. An x-ray diagnostic generator comprising an x-ray tube, a high voltage transformer supplying the x-ray tube, an inverter connected to the input of the high voltage transformer, a mains rectifier supplying power to the inverter, and control means for controlling for the x-ray tube voltage, characterized in that a smoothing circuit (6) is connected to the input of the inverter (5), and a phase gating control (7) controlling the duty cycle of the current pulses supplied to the smoothing circuit (6), said phase gating control (7) forming the control means for controlling the x-ray tube voltage.

2. An x-ray diagnostic generator according to claim 1, characterized in that the phase gating control (7) is connected between the mains rectifier (8) and the smoothing circuit (6).

* * * * *